United States Patent [19]

Stuber et al.

[11] Patent Number: 4,659,351

[45] Date of Patent: Apr. 21, 1987

[54] COMBINED PROCESS TO PRODUCE LIQUID HELIUM, LIQUID NITROGEN, AND GASEOUS NITROGEN FROM A CRUDE HELIUM FEED

[75] Inventors: Wayne G. Stuber, Whitehall; David W. Studer, Wescosville; Arthur R. Winters Jr., Coopersburg, all of Pa.

[73] Assignee: Air Products and Chemicals, Inc., Allentown, Pa.

[21] Appl. No.: 823,709

[22] Filed: Jan. 29, 1986

[51] Int. Cl.[4] ..... F25J 3/00

[52] U.S. Cl. ..... 62/18; 62/29; 62/39; 62/514 R

[58] Field of Search ..... 62/18, 23, 36, 38, 39, 62/514 R, 29

[56] References Cited

U.S. PATENT DOCUMENTS

| | | | |
|---|---|---|---|
| 3,331,213 | 7/1967 | Harmens | 62/18 |
| 3,599,438 | 8/1971 | Blackwell et al. | 62/22 |
| 3,643,452 | 2/1972 | Ruhemann et al. | 62/23 |
| 3,864,926 | 2/1975 | Collins | 62/38 |
| 3,992,167 | 11/1976 | Beddome | 62/18 |
| 4,192,661 | 3/1980 | Johnson | 62/12 |
| 4,238,211 | 12/1980 | Stuart | 62/18 |
| 4,346,563 | 8/1982 | Hood | 62/514 R |

OTHER PUBLICATIONS

"Freeze-Out Type Helium Make-Up Gas Purifier," S. C. Collins & P. R. Doherty, 6th International Congress of Refrigeration, 1971.

"Automatic Multi-range Helium Liquefaction Plant," Kneuer, Petersen & Stephan, *Cryogenics*, Mar. 1980.

Chapter 1.6-"Technology of Liquid Helium," Kropschot, Birmingham & Mann National Bureau of Standards Monograph III.

*Primary Examiner*—Ronald C. Capossela

*Attorney, Agent, or Firm*—Willard Jones, II; James C. Simmons; E. Eugene Innis

[57] ABSTRACT

The present invention is directed to a process for the purification and liquefaction of helium from a feed stream consisting essentially of nitrogen and helium with some minor impurities, wherein the helium is purified in a two step process: the first purification step comprising refrigerating the feed stream to condense nitrogen and any impurities from the feed stream, feeding the cooled feed stream to a separator, and removing from the bottom of the separator the condensed nitrogen and impurities in the feed stream and from the top of the separator a gaseous, high-helium-content stream; the second purification step comprising warming the gaseous, high-helium-content stream from the first purification step, feeding said stream to a pressure swing adsorber, and removing from the pressure swing adsorber an essentially pure helium stream, which is liquefied by feeding said essentially pure helium stream to a liquefier; wherein refrigeration is provided for the warm end of the liquefier and the two step purification; the improvement comprising providing said refrigeration by compressing a side stream of the essentially pure helium in a compressor and expanding said compressed stream in an expansion engine thereby producing a cold helium gas stream; splitting said cold helium stream into two substreams and circulating said cold helium gas stream to the warm end of the liquefier and to the two step purification to provide refrigeration duty.

2 Claims, 3 Drawing Figures

PRIOR ART

COMBINED PROCESS TO PRODUCE LIQUID HELIUM, LIQUID NITROGEN, AND GASEOUS NITROGEN FROM A CRUDE HELIUM FEED

TECHNICAL FIELD

The present invention is directed to the purification and liquefaction of liquid helium from a feed stream consisting essentially of nitrogen and helium with some minor impurities.

BACKGROUND OF THE PRIOR ART

Various processes for the purification and liquefaction off helium from a crude helium stream are known in the art.

In U.S. Pat. No. 4,192,661, a cryogenic apparatus is disclosed with an improved flow path for removing impurities introduced by a make-up stream of cryogenic fluid by directing the make-up stream to means to adsorb impurities therein prior to combining the make-up stream with the main feed stream for the cryogenic apparatus.

In a paper from the 6the International Congress of Refrigeration, Washington, D.C., 1971, by Collins and Doherty (Vol I, P95 of the Proceedings), a freeze-out type helium make-up gas purifier is described, and an article by Kneuer et al, *Cryogenics*, March 1980, (P129), an automatic multi-range helium-liquefaction plant is described.

U.S. Pat. No. 3,331,213 discloses a process for the separation of gaseous mixtures, in particular, a helium-nitrogen mixture using the higher boiling point component liquid to provide refrigeration for the process.

U.S. Pat. No. 3,599,438 discloses a process for the enrichment of a crude helium stream. The refrigeration duty required by the process is provided by an isentropic expansion of the enriched helium stream.

A typical process for purification and liquefaction of helium is shown in FIG. 1. In this process, crude helium feed is purified by a combination of cryogenic separation and non-cryogenic adsorption processes. The final cryogenic separator in the purifier typically supplies an internal liquid nitrogen stream which is rewarmed to recover refrigeration. Refrigeration requirements for the purifier are typically supplied with liquid nitrogen.

The pure helium stream produced by the purification process is then fed to a separate processing unit for liquefaction. Refrigeration for the liquefier is supplied by either expanding high-pressure recycle helium in an expansion engine or a combination of helium expansion and liquid nitrogen.

Liquid nitrogen required for purifier refrigeration, liquefier refrigeration, and other utility uses, is typically produced in a nitrogen liquefier from gaseous nitrogen extracted from the crude helium stream.

The use of separate processing units for each operation results in high capital costs and an energy-intensive process. The small nitrogen expanders used in the nitrogen liquefier are unable to provide refrigeration at high-efficiency levels.

The art as represented above has failed to disclose an efficient manner in which to both purify and liquefy helium from a crude helium feed stream in an integral unit which is energy-efficient yet not capital intensive. The solution to these problems are the objectives of the present invention.

BRIEF SUMMARY OF THE INVENTION

The present invention is directed to a process for providing refrigeration for the purification and liquefaction of helium from a feed stream consisting essentially of nitrogen and helium with some minor impurities, of the type wherein the helium is purified in a two step process: the first purification step comprising refrigerating the feed stream to condense nitrogen and any impurities from the feed stream, the second purification step comprising warming the gaseous, high-helium-content stream from the first purification step, feeding said stream to a pressure swing adsorber, and removing from the pressure swing adsorber an essentially pure helium stream; and feeding said essentially pure helium stream to a liquefier; wherein refrigeration is provided for the warm end of the liquefier and the two purification steps; the improvement comprising: (a) providing said refrigeration by compressing a side stream of the essentially pure helium in a compressor and expanding said compressed stream in an expander thereby producing a cold helium gas stream; (b) splitting said cold helium stream into two substreams; (c) circulating a first substream of said cold helium gas stream to the warm end of the liquefier to provide refrigeration duty; (d) circulating a second substream of said cold helium gas stream to the two step purification to provide refrigeration duty; (e) separating a portion of said second substream for return to the warm end off the liquefier to provide refrigeration duty; and (f) recycling the remaining portion of said second substream to the inlet of the compressor in step (a).

DETAILED DESCRIPTION OF THE INVENTION

Figure 1:
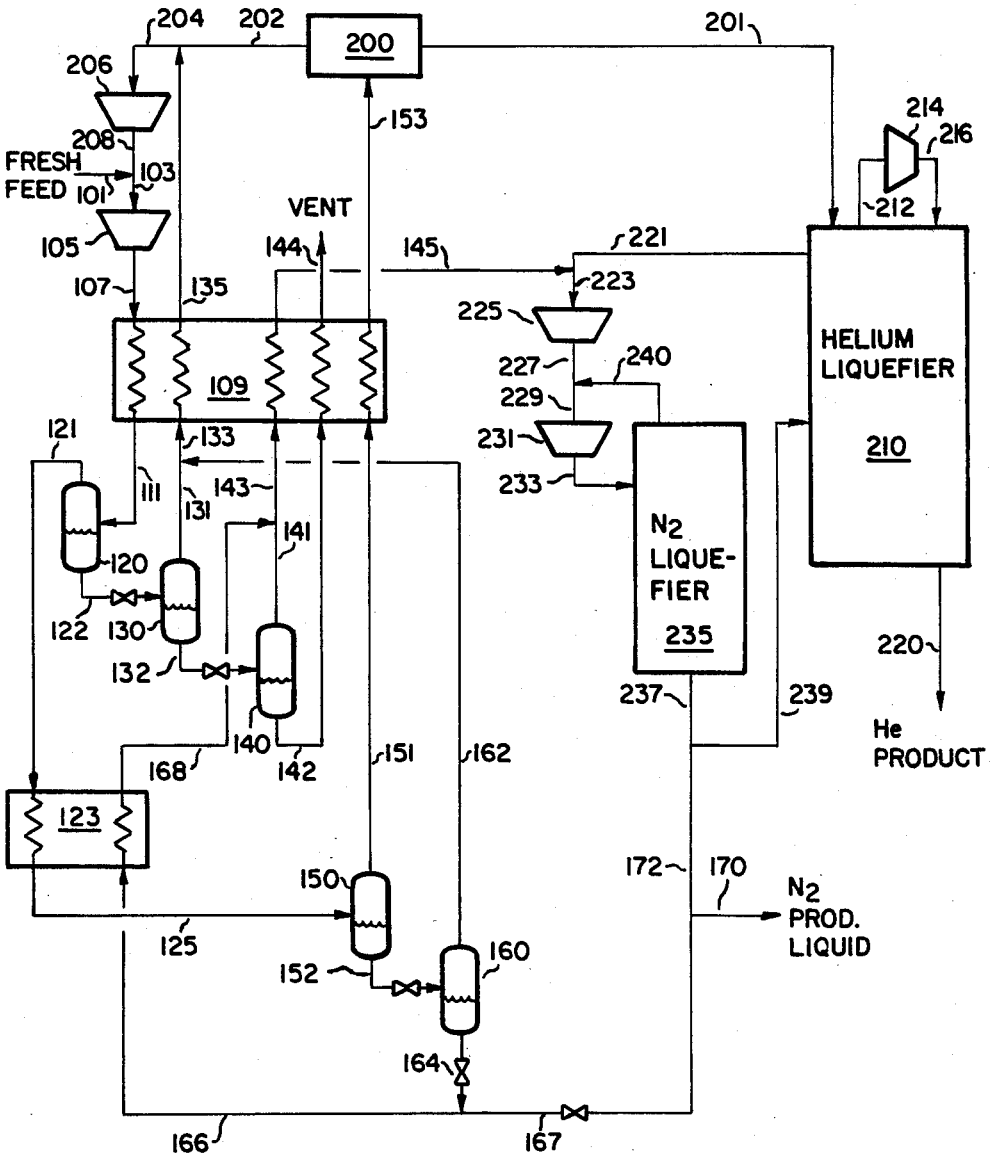
FIG. 1 is a drawing of the prior art method of purifying and liquefying helium from a crude helium stream.

A typical process for purification and liquefaction of helium is shown in FIG. 1. In this process, crude helium feed, consisting essentially of nitrogen and helium, with some minor impurities, is introduced to the system, via line 101, and is mixed with recycle helium from pressure swing adsorber (PSA) unit 200, line 202, and overheads, line 135, from separators 130 and 160 which has been warmed in heat exchanger 109, which has been compressed in compressor 206 and is in line 208 prior to mixing. The mixture of feed and recycle gas, line 103, is compressed in compressor 105, exiting as line 107, and is cooled by heat exchange with other process streams, in heat exchanger 109, to below its dew point and is fed, via line 111, to separator 120. The uncondensed vapor from separator 120 is cooled in heat exchanger 123, via line 121. In this cooling, more of the nitrogen and the impurities condense out of the vapor. The cooled vapor is fed to separator 150, via line 125, for separation of the uncondensed vapors. The uncondensed vapors from separator 150 are returned to heat exchanger 109, via line 151 for warming and are fed to PSA unit 200, via line 153. The condensed liquid from separator 150 is flashed and fed to separator 160. The condensed liquid from separator 120 is flashed and fed to separator 130, via line 122. In separator 130, the condensed liquid is flashed and fed to separator 140. The condensed liquid in separator 140, line 142, is warmed in heat exchanger 109 and is vented via line 144. The overhead stream from separator 130, line 131, is combined with the overhead stream from separator 160 and is warmed in heat exchanger 109 and recycled through line 135. The overhead from separator 140, line 141, is combined with the liquid from separator 160 after flash in valve 164 and nitrogen from nitrogen liquefier in line 167, both which have been heat exchanged in heat exchanger 123 and are now in line 168. This combined stream, line 143, is heat exchanged in heat exchanger 109 and exits the exchanger as line 145.

The stream in line 145 is combined with stream 221, return nitrogen from the warm end of helium liquefier 210. This combined stream, line 223, is compressed in compressor 225 and exits as line 227. This stream is combined with a recycle stream, line 240, from nitrogen liquefier 235 and compressed in compressor 231, prior to being fed to nitrogen liquefier 235 in line 233. Nitrogen liquefier 235 produces a liquid nitrogen stream, line 237, which is split. One portion of the liquid nitrogen stream, line 239, is circulated to the warm end of helium liquefier 210 for refrigeration duty in the warm end of the liquefier. Another portion of the liquid nitrogen stream, line 172, is used for product, line 170, and for the provision of refrigeration duty for exchangers 123 and 109.

The pure helium stream from PSA unit 200 is fed, via line 201 to helium liquefier 210. A helium recycle stream, line 212, is compressed in compressor 214 and returned to liquefier 210, via line 216, for refrigeration duty. Liquid helium product is withdrawn in line 220.

Figure 2:
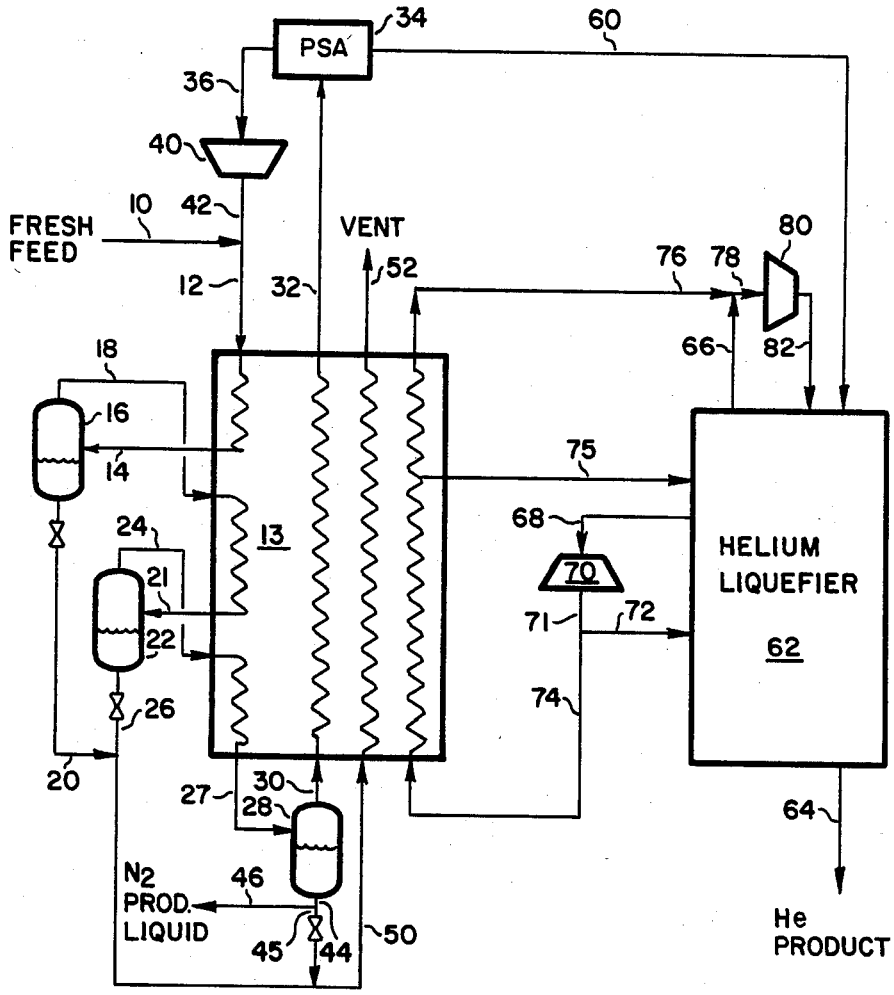
FIG. 2 is a drawing of the present invention in the preferred embodiment, which utilizes compression and expansion of a side helium stream to provide refrigeration for both the liquefier and the purifier.

The preferred embodiment of the present invention is shown in FIG. 2. Crude helium feed, consisting essentially of nitrogen and helium, with some minor impurities, is introduced to the system, via line 10, and is mixed with recycle helium from pressure swing adsorber (PSA) unit 34, line 36, which has been compressed in compressor 40 and is in line 42 prior to mixing. The mixture of feed and recycle gas, line 12, is cooled by heat exchange with other process streams, in heat exchanger 13, to below its dew point and is fed, via line 14, to separator 16. The uncondensed vapor from separator 16 is returned to heat exchanger 13, via line 18, for further cooling. In this further cooling, more of the nitrogen and the impurities condense out of the vapor. The further cooled vapor is fed to separator 22, via line 21, for separation of the uncondensed vapors. The uncondensed vapors from separator 22 are returned to heat exchanger 13, via line 24 for still further cooling. During this cooling the bulk of the nitrogen condenses out. The cooled stream is fed, via line 27, to separator 28. In separator 28, a liquid nitrogen stream is removed, via line 44, from the bottom of the separator and a gaseous stream is removed, via line 30, from the overhead of the separator. The condensed liquids from separators 16 and 22, lines 20 and 26 respectively, along with any liquid nitrogen not removed as product from separator 28, via line 46, in line 45, are flashed and combined in stream 50 and are used to partially provide heat exchange for cooling the crude helium stream introduced to heat exchanger 13, via line 12. The warmed nitrogen stream is vented via line 52. The gaseous helium stream is fed, via line 32, to PSA unit 34.

The pure helium stream from PSA unit 34 is fed, via line 60 to liquefier 62. A recycle stream of the pure helium is withdrawn from liquefier 62 via line 66, and is reunited with a recycle stream, via line 76, from heat exchanger 13, and is compressed in compressor 80 and returned to liquefier 62 in line 82. This compressed helium side stream, line 82, is heat exchanged internally in liquefier 62 and a portion is sent to expansion engine 70, via line 68. The cold helium gas from expansion engine 70, is split into two substreams. Substream 72 is returned to liquefier 62 to provide refrigeration duty. Substream 74, which is a cold helium gas stream, is circulated through heat exchanger 13 to provide refrigeration duty for condensing of nitrogen and impurities in the purification steps. Substream 74 is split, with a portion, via line 75, being returned to liquefier 62 for provision of refrigeration duty and the remainder, via line 76, is combined with stream 66 and is recycled to compressor 80. Liquid helium product is withdrawn in line 64.

Figure 3:
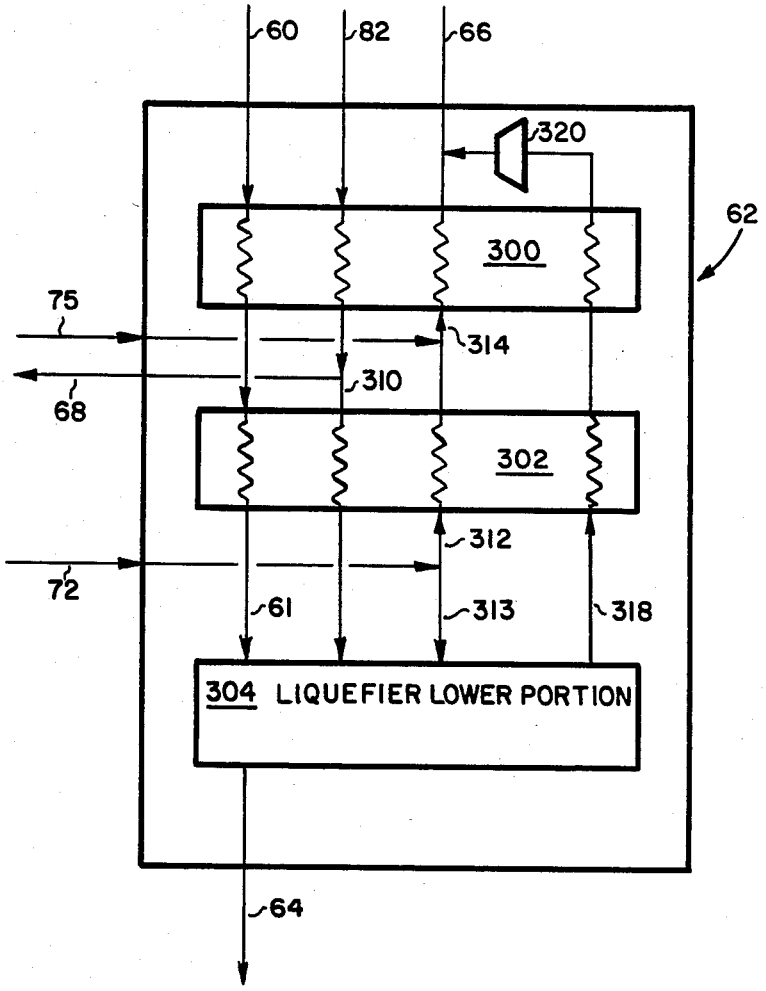
FIG. 3 is a schematic diagram of the helium liquefier section of the present invention detailing the interaction of external refrigeration streams.

The interaction of streams 60, 64, 66, 68, 72, 75, and 82 and helium liquefier 62 is shown in FIG. 3. With reference to FIG. 3, the pure helium stream from the PSA unit in line 60 is fed to liquefier 62, wherein it is cooled against warming process streams in heat exchangers 300 and 302. This cooled helium stream now in line 61 is then fed to liquefier lower portion 304. To provide refrigeration to liquefier 62, a compressed helium recycle stream in line 82 is fed to liquefier 62, cooled in heat exchanger 300, and split into two portions in lines 68 and 310. The first portion in line 310 is further cooled in heat exchanger 302 and is then fed to liquefier lower portion 304. The second portion in line 68 is removed from liquefier 62. A cold helium sidestream in line 72 is fed to liquefier 62 wherein it is split into two substreams in line 312 and 313. The first substream in line 313 is fed to liquefier lower portion 304. The second substream in line 312 is warmed in heat exchanger 302 and combined with a cold helium sidestream returning to liquefier 62 in line 75 to form the stream in line 314. This stream in line 314 is warmed in in heat exchanger 300 and then combined with an internal helium refrigeration stream in line 318 from liquefier lower portion 304 which has been warmed in heat exchangers 302 and 300 and compressed in compressor 320; the resultant recycle helium stream in line 66 is removed from liquefier 62. Liquefier lower portion 304 is a series of heat exchangers and expanders wherein further refrigeration is provided in order to liquefy the product helium stream. No particular configuration is shown for liquefier lower portion 304 because any workable configuration is acceptable for use in the process and liquefier lower portion 304 has no interaction with heat exchanger 13.

An option to the aforediscribed embodiment is not to split stream 74 from which stream 75 is returned to liquefier 62 for the provision of refrigeration duty, but to recycle the entire stream back to compressor 80.

The present invention improves the purification and liquefaction of crude helium in three areas: First, the production of good-quality liquid nitrogen from the purifier section eliminates the need for a separate nitrogen liquefaction plant, however, this advantage is partially offset by the increased size of the helium compressors and expanders, but results in a capital savings. Second, the elimination of the separate nitrogen liquefaction equipment, eliminates maintenance costs for the process. Third, employment of more efficient helium expansion refrigeration over liquid nitrogen refrigeration improves the overall efficiency of the purification and liquefaction processes.

To demonstrate the energy efficiency of the present invention, the following two examples are offered. Example 1 is a heat and material balance for the present invention as depicted in FIG. 2. Example 2, which has been provided for comparison, is a heat and material balance for the prior art as depicted in FIG. 1.

EXAMPLE 1

With reference to FIG. 2, a heat and material balance for the present invention as depicted is provided in Table I. In general, the material balance provided flow rates, temperature, pressure and stream composition for the input and output streams of the process. In the present case, stream 10 being the crude helium feed, stream 64 being the liquid helium product, stream 46 being the liquid nitrogen product and stream 52 being the vent or gaseous nitrogen product. The energy balance is around the process as shown, i.e. compressors 40 and 80 and expander 70.

TABLE I

| | Material Balance | | | |
|---|---|---|---|---|
| Stream Number: | 10 | 64 | 46 | 52 |
| Stream Name: | Feed | Liq He | Liq $N_2$ | Gas $N_2$ |
| Composition, | | | | |
| He: vol % | 48.8 | 100.0 | — | — |
| $N_2$: vol % | 47.2 | — | 96.1 | 90.8 |
| Ar: vol % | 3.0 | — | 3.3 | 6.1 |
| $CH_4$: vol % | 1.0 | — | 0.6 | 2.1 |
| Flow Rate: lb-mol/hr | 234.8 | 113.5 | 13.8 | 107.5 |
| Temperature: °F. | 82 | −452.17 | −317.74 | 82 |
| Pressure: psia | 320 | 14.2 | 90 | 12.7 |
| | Energy Balance | | | |
| Equipment Number: | 40 | 80 | 70 | |
| Equipment Name: | Compressor | Compressor | Expander | |
| Energy: bhp | 121.9 | 2408.1 | −152.5 | |

EXAMPLE 2

With reference to FIG. 1, a heat and material balance for the prior art process as depicted is provided in Table II. In general, the material balance provided flow rates, temperature, pressure and stream composition for the input and output streams of the process. In the present case, stream 101 being the crude helium feed, stream 220 being the liquid helium product, stream 170 being the liquid nitrogen product and stream 144 being the vent or gaseous nitrogen product. The energy balance is around the process as shown, i.e. compressors 105, 206, 214, 225, and 231.

TABLE II

| | | Material Balance | | | |
|---|---|---|---|---|---|
| Stream Number: | | 101 | 220 | 170 | 144 |
| Stream Name: | | Feed | Liq He | Liq $N_2$ | Gas $N_2$ |
| Composition, | | | | | |
| He: vol % | | 48.8 | 100.0 | — | — |
| $N_2$: vol % | | 47.2 | — | 97.6 | 90.6 |
| Ar: vol % | | 3.0 | — | 1.6 | 6.3 |
| $CH_4$: vol % | | 1.0 | — | 0.8 | 2.1 |
| Flow Rate: lb-mol/hr | | 234.8 | 113.5 | 13.8 | 107.5 |
| Temperature: °F. | | 82 | −452.14 | −287.12 | 95 |
| Pressure: psia | | 320 | 14.4 | 85 | 18 |
| | | Energy Balance | | | |
| Compressor Number: | 105 | 206 | 214 | 225 | 231 |
| Energy: bhp | 125.4 | 81.3 | 1547.7 | 188.0 | 1153.3 |

As can be seen from the heat and material balances in Table I and II, when both processes are producing the same product slate, the present invention has an energy requirement of 2,377.5 bhp (brake horse power) and the prior art process has an energy requirement of 3,095.2 bhp. Therefore the present invention is about 23% more energy efficient.

The present invention has been described with reference to a preferred embodiment thereof. However, this embodiment should not be considered a limitation on the scope of the invention, which scope should be ascertained by the following claims.

We claim:

1. A process for providing refrigeration for the purification and liquefaction of helium from a feed stream consisting essentially of nitrogen and helium with some minor impurites, of the type wherein the helium is purified in a two step process: the first purification step comprising refrigeration the feed stream to condense nitrogen and any impurities from the feed stream, and separating the cooled feed stream into a condensed nitrogen and impurities stream and a gaseous, high-helium content stream; the second purification step comprising warming the gaseous, high-helium-content stream from the first purification step, feeding said stream to a pressure swing adsorber, and removing from the pressure swing adsorber an essentially pure helium stream; and feeding said essentially pure helium stream to a liquefier comprising:

(a) providing said refrigeration by compressing a side stream of the essentially pure helium in a compressor and expanding said compressed stream in an expansion engine thereby producing a cold helium gas stream;

(b) splitting said cold helium stream into two substreams;

(c) circulating a first substream of said cold helium gas stream to the warm end of the liquefier to provide refrigeration duty;

(d) circulating a second substream of said cold helium gas stream to the two step purification to provide refrigeration duty;

(e) separating a portion of said second substream for return to the warm end of the liquefier to provide refrigeration duty; and (f) recycling the remaining portion of said second substream to the inlet of the compressor in step (a).

2. A process for providing refrigeration for the purification and liquefaction of helium from a feed stream consisting essentially of nitrogen and helium with some minor impurities, of the type wherein the helium is purified in a two step process: the first purification step comprising refrigerating the feed stream to condense nitrogen and any impurities from the feed stream, and separating the cooled feed stream into a condensed nitrogen and impurities stream and a gaseous, high-helium content stream; the second purification step comprising warming the gaseous, high-helium-content stream from the first purification step, feeding said stream to a pressure swing adsorber, and removing from the pressure swing adsorber an essentially pure helium stream; and feeding said essentially pure helium stream to a liquefier comprising:

(a) providing said refrigeration by compressing a side stream of the essentially pure helium in a compressor and expanding said compressed stream in an expansion engine thereby producing a cold helium gas stream;

(b) splitting said cold helium stream into two substreams;

(c) circulating a first substream of said cold helium gas stream to the warm end of the liquefier to provide refrigeration duty;

(d) circulating a second substream of said cold helium gas stream to the two step purification to provide refrigeration duty;

(e) recycling said second substream to the inlet of the compressor in step (a).

* * * * *